United States Patent [19]

Saint Laurent

[11] Patent Number: 4,785,792

[45] Date of Patent: Nov. 22, 1988

[54] MODULAR OUTDOOR HEATING SYSTEM

[76] Inventor: F. Richard Saint Laurent, 36 Blanding Rd., Rehoboth, Mass. 02769

[21] Appl. No.: 69,716

[22] Filed: Jul. 6, 1987

[51] Int. Cl.[4] ..... F24H 1/00

[52] U.S. Cl. ..... 126/344; 126/350 R; 122/37

[58] Field of Search ..... 126/344, 350 R, 132; 122/20 A, 37; 237/56, 57, 62; 4/493; 52/475, 476

[56] References Cited

U.S. PATENT DOCUMENTS

| | | | |
|---|---|---|---|
| 2,506,721 | 5/1950 | Kluck | 126/350 R |
| 2,841,337 | 7/1958 | Haugen | 126/350 R X |
| 3,623,458 | 11/1971 | Block | 126/350 R X |
| 3,659,560 | 5/1972 | Carter | 126/350 R X |
| 4,344,386 | 8/1982 | Black | 126/350 R X |
| 4,352,454 | 10/1982 | Ewing | 126/132 |
| 4,501,232 | 2/1985 | Gordbegli et al. | 126/344 X |

*Primary Examiner*—Randall L. Green

*Attorney, Agent, or Firm*—Robert J. Doherty

[57] ABSTRACT

A modular outdoor heating system comprising a heating module and generally a fuel module both modules being enclosed, insulated, and positioned outdoors adjacent the building to be heated. The heating module contains a complete hydronic heating unit including boiler, burner, water circulation system, and positive air draft system while the fuel module includes an oil storage tank with associated fill and vent means. The modules are interconnected so that heat from the boiler keeps both modules warm and dry.

3 Claims, 3 Drawing Sheets

MODULAR OUTDOOR HEATING SYSTEM

BACKGROUND AND OBJECTS OF THE INVENTION

This invention relates to an outdoor heating system for houses and other small buildings wherein the hydronic boiler and associated burner, including other controls normally associated therewith and preferably including the fuel supply, are located completely outside and housed within insulated modules.

Presently and especially in the less temperate climate areas of the United States and elsewhere, hydronic home heating systems are almost entirely located within the house structure itself and most often in the basement. There are situations, however, when basement or indoor locations of such hydronic systems are either impossible or impractical. Thus when a home is converting from electric to oil or gas heat, it is usually necessary to include a chimney structure which is not always present and is expensive to provide. Additionally when space is at a premium, it would be desirable to use the required heating system space for storage or living space.

Further drawbacks of interior hydronic heating systems include the noise, oil combustion fumes, and odors associated with the storage and combustion of the fuel, generally oil, but also including natural and LP gas as well. Furthermore with such interior placement of burner units, it is necessary that combustion air either be drawn from the outside or that already heated interior air be used for such purpose which generally requires either added structural complexities or a lower heating system efficiency. This is particularly true with today's highly insulated homes in which oxygen starvation for the burner unit is often a problem due to the reduced outside air infiltration. Also, the location of a burner in the basement of a home produces a slight negative pressure therein which tends to draw undesirable pollutants, such as radon gas, from the surrounding ground soil into the home atmosphere.

It is thus apparent that these above-indicated problems could be eliminated by the outside placement of the home heating system. While some such earlier attempts have been made primarily through necessity due to inadequate interior space, they have not met with particular success.

Previous outdoor boilers do not attempt to locate the boiler and all its components inside a separate inside enclosure as the outdoor heating module. They take a conventional boiler and replace its insulated jacket with a non-corrosive insulated jacket which also encloses the burner and controls. This exposes the boiler burner and controls directly to low outside temperatures causing condensation to form on the boiler, burner, and controls with resulting corrosion and service problems. Previous outdoor units also make no attempt to enclose the air elimination tank and equipment and purge and fill stations. Their design requires them to be located inside the dwelling. Previous units do not employ a forced draft flue gas exhaust system as the outdoor heating module. They rely on an opening in the top of their units to remove flue gases by natural draft. The arrangement produces varying positive draft conditions which prevent proper exhaust of the flue gases and also causes positive pressure to accrue inside the combustion area.

The result is numerous service problems and excessive soot accumulation.

Such outdoor placement of the heating system components further includes the common outdoor placement of a storage tank, that is, a free standing, uninsulated tank most commonly feeding a boiler and burner unit located indoors. It is also commonly known to bury storage tanks also most commonly associated with the indoor location of boiler and burner units. Such limited outdoor disposition of heating system portions has not met with general acceptance and has furthermore led to specific problems associated with such outdoor disposition.

Thus, it is now becoming apparent that buried underground fuel storage tank leaks can cause environmental problems as well as being costly to repair. Also, normal outdoor disposition of oil storage tanks further can cause condensation inside the storage tank which mixes with the fuel oil causing fuel stoppage when the condensation freezes in the oil line or direct sludging of the fuel oil itself from exposure to very low temperatures also causing fuel stoppage. Problems associated with the outdoor boiler placement revolve around its exposure to low outside temperatures which can cause condensation to form on the boiler, burner, and controls with resulting corrosion and service problems. Such known outdoor boiler units also made no attempt to enclose the air elimination tank, much of the electrical equipment, the circulation system, and purge and fill stations. Normally, such systems located such equipment within the house. Also, previous systems have never attempted to joint a heating module with the fuel supply.

It is, accordingly, an object of the present invention to provide an outdoor hydronic heating system which eliminates the above-discussed problems and is convenient to use, trouble free in operation, and provides the maximum positive results from such placement. Such is accomplished by having a standard hydronic boiler unit with its associated burner controls within an insulated module and connecting such module to an insulated fuel storage module such that both modules are interconnected and insulated in such a fashion that the heat produced from the boiler provides a desirable warm atmosphere to the entire heating system located outside the house it services. In addition, substantial benefits are provided by solely positioning the entire hydronic boiler system within its own completely enclosed and insulated module located entirely outside the house to which a conventionally located fuel supply system (either in the house, buried or free standing) may be connected.

Accordingly, these and other objects of the present invention are accomplished by the provision of a self-contained, complete hydronic home heating module adapted for outdoor use adjacent the home, said heating module comprising a rigid base on which a hot water boiler including an associated fuel burner is attached, side walls upwardly extending from said bottom wall and a top wall attached to said side walls so as to completely enclose the interior spaced formed by said module, at least said side walls and said top wall being insulated, one of said walls having a combustion air inlet to supply outside air to a forced air draft system in turn operatively associated with said boiler and including an exhaust gas outlet passing through one of said walls, said module further containing a hot water circulating system including a pump with attached inlet and outlet piping for connection to the inlet and outlet positioned within the home and in turn connected to the heat distribution system located therein, and an electrical system for energizing said burner, said draft system and said hot water circulation system, and at least one of said side walls being a quick removable panel to provide working access to the interior of said module.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
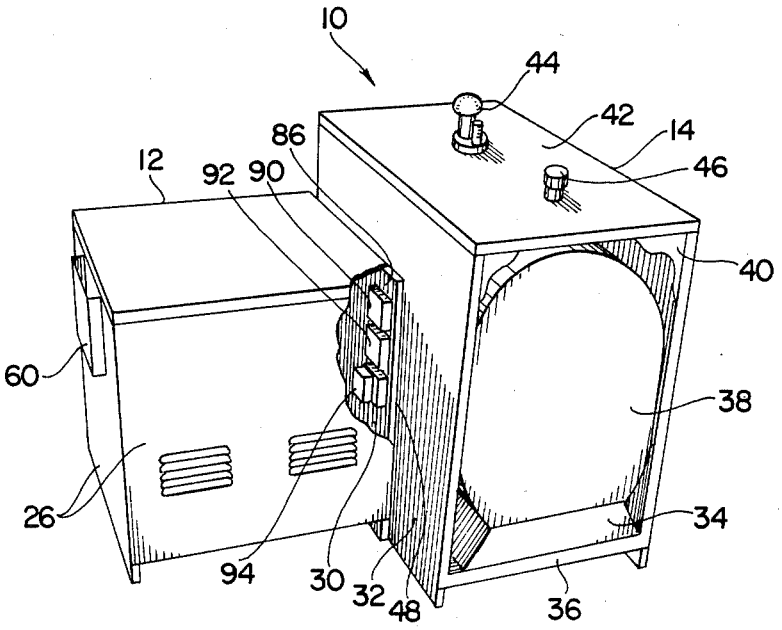
FIG. 1 is perspective view with portions cut away showing the outdoor modular heating system of the present invention.

The outdoor heating system 10 of the present invention includes two major components, that is, the heating module 12 and the fuel module 14. The heating module 12 is adapted to be used either alone or in combination with the fuel module 14 such that the heat generated by the heating module 12 creates a warm, shared environment for the entire system, that is, both the heating module 12 and the fuel module 14, such that fuel freezing, condensation, rust, and other disadvantages of previous outdoor heating system components are eliminated.

The heating module 12 includes a base 16 preferably formed of steel plate and raised by interconnected side plates 18 such that the lift mechanism of a fork lift truck may be used to move the module when necessary and to provide a support spaced off the ground when positioned in use. Welded or otherwise suitably attached to the base 16 are side and top frame members 20. Such frame members are suitably attached to each other by bolting, welding, and the like to provide a generally rigid supporting frame 24.

In order to make the heating module weatherproof, enclosure panels 26 are provided on the front, rear, and left side of the unit when intended for use in conjunction with the fuel module 14 and the right side when used as a free standing unit such that the entire heating unit is enclosed and insulated. Such panels 26 are formed of sheet material such as 20 gauge galvanized steel and include inwardly extending peripheral lips such that they may be suitably fastened to the frame members 20 as by sheet metal screws. Insulation, preferably in the form of one inch rigid fiberglass duck board, is attached to the inside surface of the panels 26 as by gluing. In addition, it is preferably that at least the front and rear panels be easily removable for servicing.

When the heating module 12 is used in conjunction with the fuel module 14, it should be pointed out that the right hand side of the heating module 14 is provided with no insulating enclosure and is adapted for adjacent placement to an opening 30 provided in the left side wall of the fuel module 14. In that regard, the fuel module 14 includes a base 34 including legs 36 into which an oil storage tank 38 is supported as by weld attachment thereto. Side panels 32 formed from sheet metal and including interior insulation are attached to the base 34 as are front and rear panels 40 and a top panel 42. A fill pipe 44 extends upwardly through the top panel 42 as well as a fuel gauge 46. The opening 30 includes a peripheral lip 48 which outwardly extends from the adjacent side panels 32 and to which the adjacent panel 26 of the heating module 14 may be attached. The net result is, as previously indicated, an interconnected, insulated, weatherproof environment for both the fuel tank and the heating unit of the system when used in its attached configuration as above explained.

Figure 2:
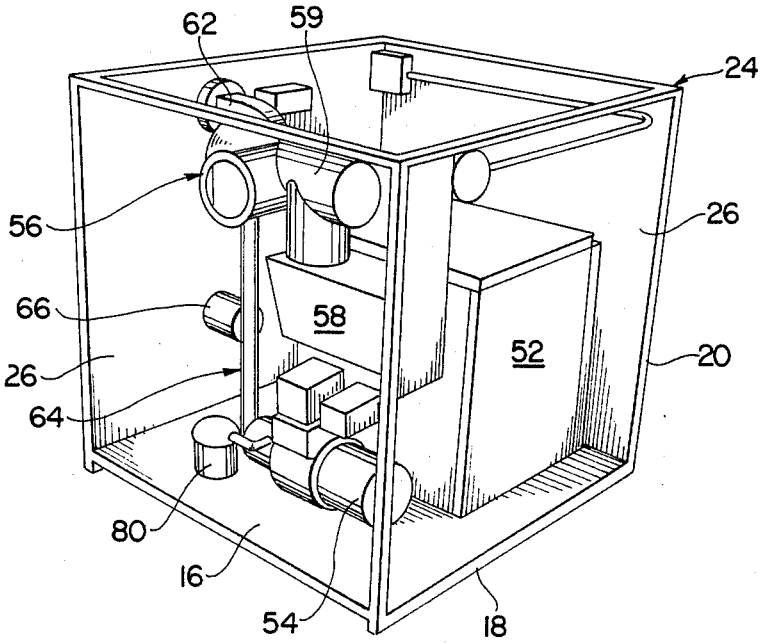
FIG. 2 is a perspective view showing the heating module of the system with the front and rear insulating panels removed for clarity.
Figure 3:
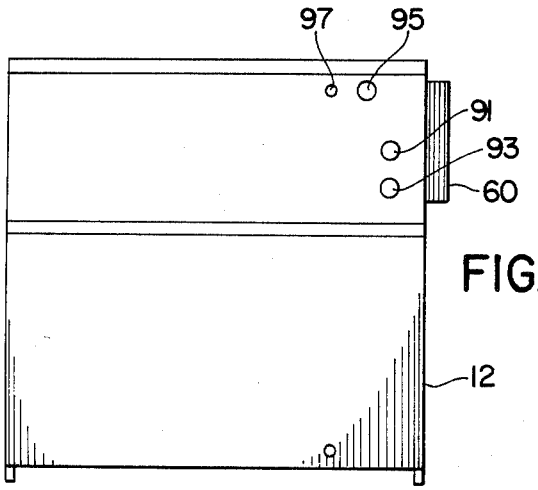
FIG. 3 is a rear elevational view of the heating module portion of FIG. 1.
Figure 4:
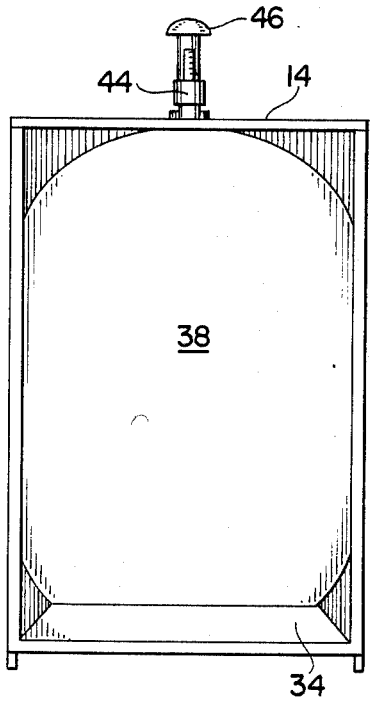
FIG. 4 is a front elevational view of the fuel module portion of the system shown in FIG. 1 with the front panel thereof removed for clarity.
Figure 5:
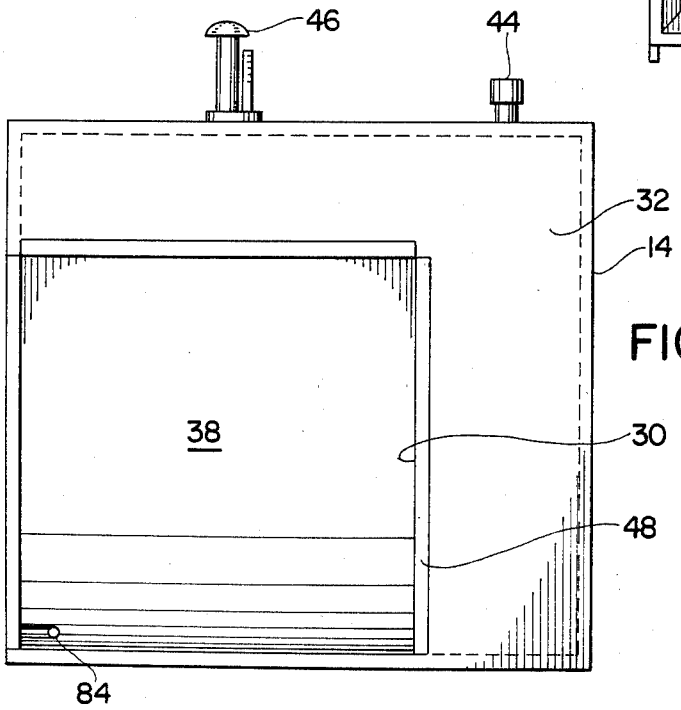
FIG. 5 is a left side elevational view of the fuel module.

Turning now again to the heating module 12, such includes a hot water boiler 52 complete with an oil burner 54 including controls and a relief valve. Also, a forced draft system 56 for continuous negative draft operation is included to eliminate the need for a chimney. Such draft system 56, including suitable ducts 59, connects to a plenum 58 attached to the boiler and exits through an air vent 60 in the left side panel 26. Power is provided by a blower 62. The forced flue gas removal system 56 is best shown in FIGS. 2, 6 and 7.

Figure 6:
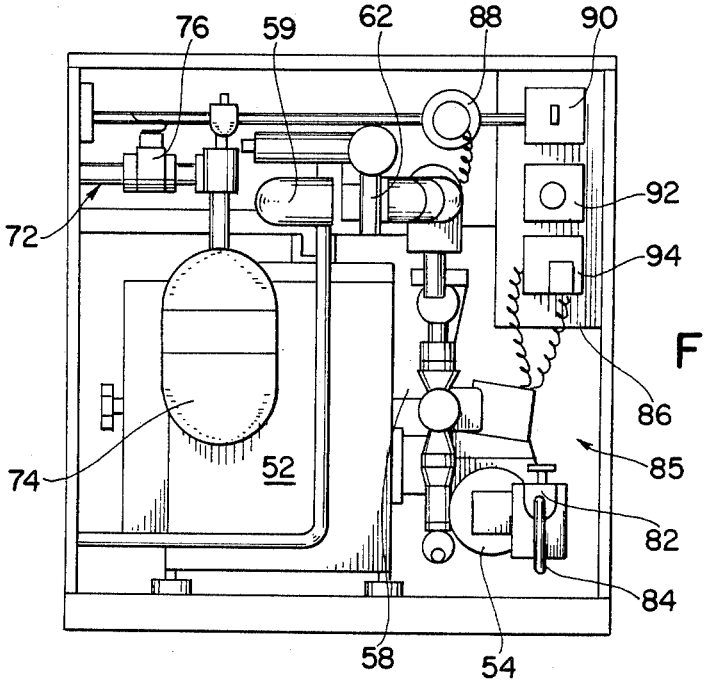
FIG. 6 is a side elevational view of the heating module with the side panel thereof removed showing the operational and control features of the heating unit.
Figure 7:
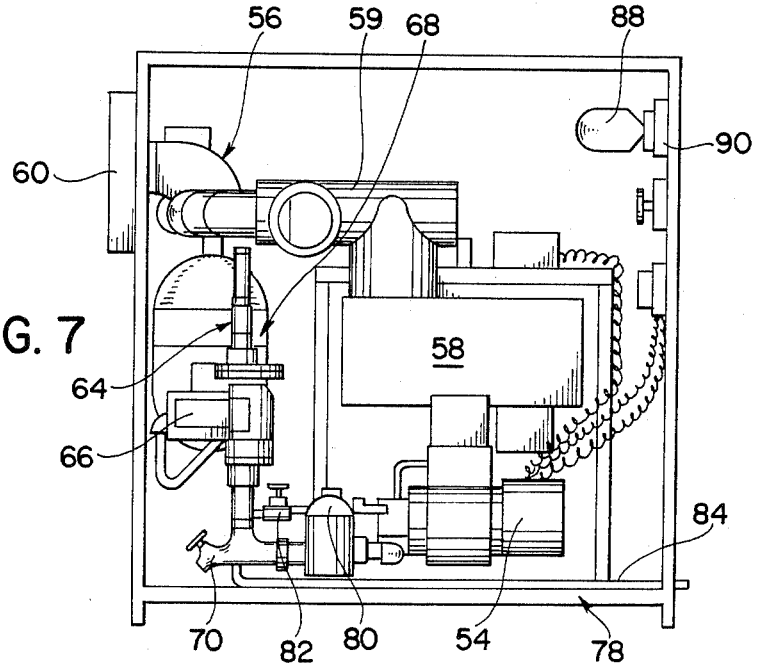
FIG. 7 is a front elevational view of the heating module with the front panel thereof removed similar to FIG. 6.

The boiler 52 is further provided with a return water system 64 as best shown in FIGS. 6 and 7 which includes a water circulator 66 and purge and fill stations 68 and 70 respectively. In this regard, it should be pointed out that the zone valve or valves mounted within the structures served by the heating system 10 are electrically connected to the burner 54, water circulator 66, and other essential controls within the module 10. Besides the return piping system 64, a supply piping system 72 is included in the heating module 12. Such supply system 72 is best shown in FIG. 6 and includes an expansion tank 74 and an air elimination valve 76. Fuel is supplied to the boiler 52 through an oil supply system 78 as best shown in FIG. 7 which includes an oil filter 80, a fusible valve 82, and a direct connection line 84 to the fuel module 14 for connection to the tank 38 mounted therein.

Turning now to FIGS. 6 and 7 in particular, the electric control system 85 is best shown. In that regard, an electrical service panel 86 is mounted within the heating module 12 preferably on the right side thereof, that is, that side adapted for adjacent placement to the fuel module 14. Such panel 86 includes an electrical service light with switch 88, an electrical service box 90, a fusible electric cut off switch 92, and suitable relays 94 and other electrical components for the flue gas removal system. In this manner then when the front panel 26 is removed for servicing, the technician will be able to illuminate the module 12 interior by turning on the light 88 and have a source of electrical power through the service box 90. In this connection, it should also be pointed out that both hydronic and electrical connection is provided in the rear panel 26 for quick hookup to the house which the heating system 10 of the present invention services. Such, as best shown in FIGS. 7 and 8, includes a water supply inlet 91, a water return inlet 93, a line voltage connection 95, and a low voltage connection 97.

It may be seen thus from the above description that a self-contained heating system 10 is provided which accomplishes all the desirable objects heretofore elicited without the attendant disadvantages of previous systems. It should be pointed out that although the system composed of the heating module 12 and the fuel module 14 are adapted to be used together, there are occasions when the heating module itself fitted as a self-contained, entirely insulated unit can be used alone and will provide many advantages previously indicated. In other words, the heating module 12 could be used with natural of LP gas which fuels are not as adversely affected by low temperatures as is fuel oil. In that regard, the oil burner 54 would, of course, be replaced by a burner suitable for consuming the alternate fuels, and the boiler 52 would also be suitably replaced or modified. The hydronic boiler 52 shown in the drawings is an Axeman Anderson OLP-119 steel, horizontal tube, wet base design unit powered by a Beckett AFG unit; however, as above explained, any suitable boiler or burner may be utilized.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An outdoor hydronic home oil heating system including a heating module and a fuel module adapted for side to side operative positioning with each other, said modules being weatherproof and insulated, said heating module containing a complete hydronic heating unit including an insulated hot water boiler, an oil burner, a water circulation system, a forced combustion air draft system and an electrical system for energizing said heating unit, said fuel module containing an oil storage tank with associated fill and vent means, and capacity gauge, both said modules having panel openings adapted for contiguous disposition such that the same interior atmosphere environment is shared by said modules so that the heat generated by said heating module will provide heat to the interior of said fuel module.

2. The heating system of claim 1, said heating module including a base, said base being generally rectangular and including an upstanding skeletal frame of generally parallelogram configuration to which individual insulated panels are attached to form surrounding side walls and a top wall so as to completely enclose said heating module.

3. The heating system of claim 2, said fuel module including insulated upstanding side walls and an insulated top wall so as to insulate said enclosed fuel module.

* * * * *